United States Patent [19]

Murr et al.

[11] 4,354,649

[45] Oct. 19, 1982

[54] ARRANGEMENT FOR CONTINUOUSLY CONTROLLING TRACK-BOUND VEHICLES

[75] Inventors: Eduard Murr, Kirchseeon; Siegfried Gersting, Munich; Helmut Übel, Leonberg; Alan C. Knight, Korntal-Müchingen, all of Fed. Rep. of Germany

[73] Assignee: International Standard Electric Corporation, New York, N.Y.

[21] Appl. No.: 109,389

[22] Filed: Jan. 3, 1980

[30] Foreign Application Priority Data

Jan. 19, 1979 [DE] Fed. Rep. of Germany ..... 2901994

[51] Int. Cl.[3] ..... B61L 3/00; B61L 21/00

[52] U.S. Cl. ..... 246/187 B; 246/34 CT; 246/63 C

[58] Field of Search ..... 246/187 B, 63 R, 63 C, 246/34 R, 34 CT, 122 R, 247, 249, 63 A; 340/147 SC, 825.01

[56] References Cited

U.S. PATENT DOCUMENTS 1,803,453 5/1931 Affel ..... 246/63 R
3,877,666 4/1975 Itakura et al. ..... 246/187 B
3,904,157 3/1975 Kuhl ..... 246/63 C
4,132,379 1/1979 Schwarzalder ..... 246/187 B

FOREIGN PATENT DOCUMENTS 1019828 10/1977 Canada ..... 246/187 B

*Primary Examiner*—James J. Groody
*Attorney, Agent, or Firm*—John T. O'Halloran; Alfred C. Hill

[57] ABSTRACT

An arrangement enabling continuous control of vehicles on a track divided into individual areas comprises at least one track-conductor loop associated with the track in each of the areas having N transpositions therein, where N is an integer greater than two, the loop communicating data between the vehicles and a fixed control station by being coupled at opposite ends thereof to a different one of two supply units coupled to the control station and by being inductively coupled to communicating equipment on the vehicles. The one loop further comprises coupling elements disposed intermediate adjacent ones of the N transpositions to subdivide the loop into N track-conductor loops.

6 Claims, 3 Drawing Figures

ARRANGEMENT FOR CONTINUOUSLY CONTROLLING TRACK-BOUND VEHICLES

BACKGROUND OF THE INVENTION

The present invention relates to an arrangement for the continuous control of track-bound vehicles and more particularly to such an arrangement where data is communicated between a fixed control station and the vehicles by track-conductor loops which are AC fed by supply units coupled to the control station and which are inductively coupled to the vehicles.

German Pat. No. (DE-OS) 2,402,932 discloses a continuous vehicle control arrangement in which the track-conductor loops are formed by several short, shunt-fed track-conductor loops instead of by one long loop. That arrangement has the advantage that when a loop fails—e.g. due to damage to a track conductor—data communication between vehicle and track can continue, for the vehicles are capable of traversing one short-loop length without information.

Providing a track with short loops in the known manner is very expensive because the shunt feed requires a large number of supply units, referred to as "isolation devices" in the above cited German patent. Even more supply units are needed if a redundant arrangement of short loops as shown in FIG. 4 of the above-cited German patent is used.

SUMMARY OF THE INVENTION

An object of the invention is to provide an arrangement for continuously controlling track-bound vehicles which requires considerably fewer supply units than the known arrangement, with unchanged safety and reliability of operation.

A feature of the present invention is the provision of an arrangement for continuously controlling track-bound vehicles on a track divided into individual areas comprising in each of the areas at least one track-conductor loop having N transpositions therein, where N is an integer greater than two, the one loop communicating data between the vehicles and a fixed control station by being coupled at opposite ends thereof to a different one of two supply units coupled to the control station and by being inductively coupled to communicating equipment on the vehicles; and coupling elements disposed in the one loop intermediate adjacent ones of the N transposition to subdivide the loop into N track-conductor loops.

The number of supply units is reduced by forming groups of three and more successive track-conductor loops and feeding the group of loops from both ends through only two supply units, instead of assigning one supply unit to each loop as in the known arrangement.

By employing coupling elements in the form of transformers with each of their windings having a center tap connected to a common potential, phase jumps and sudden amplitude changes of the received signal when the vehicles are passing over loop transitions are prevented. The track-conductor loop includes a plurality of loop crossovers or transitions greater than two and a load such as a resistor, a capacitor or a resistor-capacitor combination may be provided intermediate the transitions to connect the conductors of the loop to in effect divide the loop into a plurality of loop sections greater than two.

Preferably the supply units provide an output current which is nearly independent of the characteristic impedance of the track-conductor loop which diminishes a reduction in received signal strength caused by a failure of a supply unit or by breaks in the track conductor.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
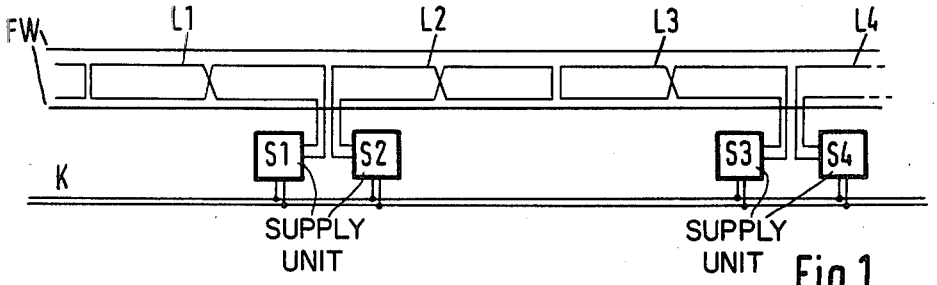
Fig.1 (PRIOR ART)
FIG. 1 shows schematically a track equipped with the known arrangement.

FIG. 1 shows a route FW, e.g. a railroad line. Track-conductor loops L1 . . . L4, each of which is transposed once, are laid in the center of the track. Each of these track-conductor loops is fed via a supply unit S1 . . . S4 of its own. In the above-cited German patent, these supply units, called "isolation devices" there, are connected via a cable K to a transceiver (not shown) which, in turn, is connected to a central computer or control system. The supply units (isolation devices) S1 . . . S4 receive the information in parallel as a frequency-modulated signal, which they amplify before feeding it into the track-conductor loops. Any phase differences at the transitions between the loops, which may simulate transpositions of the track-conductor loops, are eliminated at the receiving end.

Figure 2:
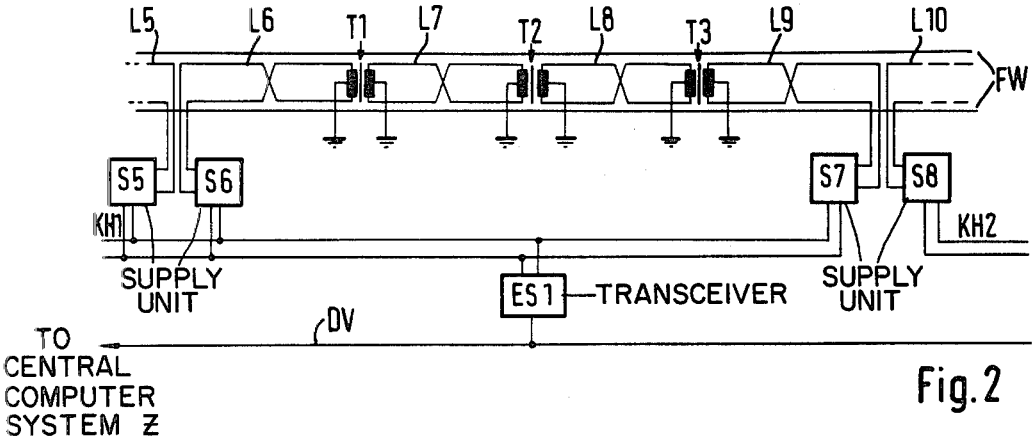
FIGS. 2 and 3 show schematically two tracks each having a different one of two embodiments in accordance with the principles of the present invention.

FIG. 2 shows a first embodiment of the arrangement according to the invention.

Four track-conductor loops L6 . . . L9 each of which is transposed once are arranged along the track FW. They are coupled together by means of transformers T1 . . . T3 and form a group of loops. The group is fed simultaneously from both of its ends by means of two supply units S6 and S7. As in the known arrangement, the supply units S6 and S7 of a track area are fed in phase from a common transceiver ES1 via a high-frequency cable and, in turn, feed the frequency-modulated signal substantially in phase into the track-conductor loops L6 and L9 after amplifying the signal with impressed current.

Neighboring loops L5 and L10 belong to other loop groups, and the loop L10 also belongs to another track area. This is apparent from the fact that the supply unit S8, coupled to the loop L10, is connected not to the transceiver ES1 but, via a high-frequency cable KH2, to another transceiver (not shown). The transceivers of several track areas are connected to a central computer system Z via data links DV.

Both windings of the transformers T1 . . . T3 within the loop groups have center taps which are connected to a common potential, in the case of a railroad line to rail potential. This insures symmetrical operation of all loops of the loop group.

If damage is caused to the track-conductor loops which results in an interruption of track-conductor current—such damages have turned out to be by far the most frequent cause of errors on railroad lines operating under continuous automatic train control—a failure of transmission will occur only along the track-conductor loop directly affected, just as in the known arrangement. The neighboring loops are terminated by the transformer windings associated with them, and continue to be supplied from the supply unit located in the direction opposite to the fault. Because of the short loop length, the mismatch resulting from the break in the track-conductor loop has only a very limited effect. A decrease in loop current as a result of a sudden no-load condition of the transformers connected to the faulty loop is automatically prevented by an increase in the output voltage of the supply units S6 and S7, which work with impressed current.

Even if a supply unit fails, communication can continue provided that the signal level at that end of a loop opposite the supply unit functioning properly is sufficient for error-free transmission. This condition also determines the maximum number of loops that can be coupled to form a group. Since this number is, in any case, greater than two, fewer supply units are required than in the known arrangement.

Figure 3:
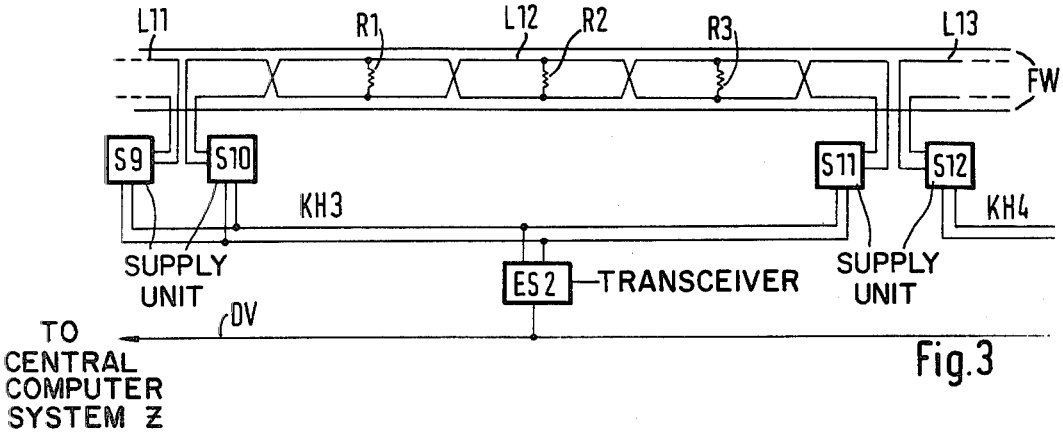

FIG. 3 shows another embodiment of the arrangement according to the invention, which is based on another variant of the solution.

Here, too, the track FW is fitted with track-conductor loops L11, L12, L13. The loops (e.g. L12) are about as long as one group of loops in the embodiment just described with respect to FIG. 2, but are divided by means of additional load resistors R1 . . . R3 into sections equal in length to the track-conductor loops of the known arrangement and to the coupled loops of FIG. 2. Such a divided loop is supplied from both ends through supply units S10 and S11, as in the group of loops shown in FIG. 2.

It can be shown that in this arrangement, too, a track-conductor loop break will lead to a failure of transmission over only a very short distance. If the track-conductor loop is interrupted in the region between the resistors R2 and R3, for example, track-conductor current will continue to flow from the supply units S10 through R1 and R2 and from the supply unit S11 through R3. Thus, the loop sections between S10 and R2 and between S11 and R3 will continue to be supplied with current of the same strength as if the track-conductor loop was faultless. Similarly to the embodiment shown in FIG. 2, failure of a supply unit causes only a reduction of power level, particularly in that portion of the track-conductor loop which is further from the supply unit functioning properly. The permissible degree of level reduction determines the maximum length of the loop.

While we have described above the principles of our invention in connection with specific apparatus, it is to be clearly understood that this description is made only by way of example and not as a limitation to the scope of our invention as set forth in the objects thereof and in the accompanying claims.

We claim:

1. An arrangement for continuously controlling track-bound vehicles on a track divided into individual areas comprising:

in each of said areas at least one track-conductor loop having N transpositions therein, where N is an integer greater than two, said one loop communicating data between said vehicles and a fixed control station by being coupled at opposite ends thereof to a different one of two supply units coupled to said control station and by being inductively coupled to communicating equipment on said vehicles, said two supply units feeding said data to said opposite end of said one loop substantially in phase; and coupling elements disposed in said one loop intermediate adjacent ones of said N transpositions to subdivide said one loop into N track-conductor loops.

2. An arrangement according to claim 1, wherein each of said N loops is a separate independent track-conductor loop having one transposition disposed in a tandem relationship with the others of said N loops, and each of said coupling elements includes a transformer disposed between adjacent ends of adjacent ones of said N loops to provide said one loop.

3. An arrangement according to claim 2, wherein each of said transformers include a pair of windings each having a center tap connected to a common potential.

4. An arrangement according to claim 1, wherein each of said coupling elements includes a load impedance coupled between conductors of said one loop.

5. An arrangement according to claim 4, wherein each of said loads is a resistor.

6. An arrangement according to claims 1, 2, 3, 4 or 5, wherein each of said two supply units provide an output current which is substantially independent of the characteristic impedance of said one loop.

* * * * *